US009506656B2

(12) United States Patent
Gravel

(10) Patent No.: US 9,506,656 B2
(45) Date of Patent: Nov. 29, 2016

(54) COOKING STOVE

(71) Applicant: International Clean Energy Solutions, Ltd.

(72) Inventor: Marco Gravel, St-Constant (CA)

(73) Assignee: International Clean Energy Solutions, Ltd., Basseterre (KN)

( * ) Notice: Subject to any disclaimer, the term of this patent is extended or adjusted under 35 U.S.C. 154(b) by 476 days.

(21) Appl. No.: 14/043,011

(22) Filed: Oct. 1, 2013

(65) Prior Publication Data

US 2015/0090246 A1 Apr. 2, 2015

(51) Int. Cl.

| | |
|---|---|
| ***F24C 5/20*** | (2006.01) |
| ***F23C 7/00*** | (2006.01) |
| ***F23D 5/04*** | (2006.01) |
| ***F23K 5/10*** | (2006.01) |
| ***F24C 5/12*** | (2006.01) |
| *F23L 17/10* | (2006.01) |

(52) U.S. Cl.

CPC ..... *F24C 5/12* (2013.01); *F23C 7/002* (2013.01); *F23D 5/04* (2013.01); *F23D 5/045* (2013.01); *F23K 5/10* (2013.01); *F24C 5/20* (2013.01)

(58) Field of Classification Search

CPC ..... F24C 5/12; F24C 5/20; F24C 5/18; F24C 1/00; F24C 15/00; F24C 15/10; F23C 7/002; F23C 7/008; F23C 2700/023; F23D 5/04; F23D 5/045; F23D 5/123; F23K 5/10; F23K 5/02; F23L 2700/001; F23L 17/10; F23L 17/005; F23L 17/00

USPC ..... 126/43, 350.1, 30, 37 R, 51, 50, 312

IPC ..... F24C 5/20, 5/12, 5/18; F23C 7/00; F23D 5/04; F23L 17/10; F23K 5/10

See application file for complete search history.

(56) References Cited

U.S. PATENT DOCUMENTS

| | | | | | |
|---|---|---|---|---|---|
| 38,732 | A | * | 6/1863 | Dick | F23D 3/40 122/17.1 |
| 199,619 | A | * | 1/1878 | Corby | F23J 13/00 126/312 |
| 431,395 | A | * | 7/1890 | Otto | F24C 5/06 126/45 |
| 621,962 | A | * | 3/1899 | Denayrouze | F23D 11/30 431/108 |
| 832,019 | A | * | 9/1906 | Kallsen | F23J 13/00 126/312 |
| 914,134 | A | * | 3/1909 | Galitz | F23L 17/10 416/244 R |
| 1,176,172 | A | * | 3/1916 | Schleusselburg | F24C 5/20 126/43 |
| 1,222,346 | A | | 4/1917 | Adams | |

(Continued)

FOREIGN PATENT DOCUMENTS

| | | | |
|---|---|---|---|
| CN | 201398842 | Y | 2/2010 |
| CN | 201378816 | Y | 6/2010 |

(Continued)

OTHER PUBLICATIONS

"FR_2912205_A3_M—Machine Translation.pdf", Machine Translation, European Patent Office, Jan. 16, 2016.*

*Primary Examiner* — Gregory Huson
*Assistant Examiner* — Daniel E Namay
(74) *Attorney, Agent, or Firm* — Christopher M. Ramsey; GrayRobinson, P.A.

(57) ABSTRACT

The invention relates to a stove that operates using liquid fuel of alcohol and water that can be diluted to concentrations as low as 50% alcohol by volume.

16 Claims, 16 Drawing Sheets

(56) References Cited

U.S. PATENT DOCUMENTS

| | | | | | |
|---|---|---|---|---|---|
| 1,300,594 | A * | 4/1919 | Ferdon | F24C 5/02 | 126/38 |
| 1,362,044 | A * | 12/1920 | Reich | F23L 17/10 | 454/15 |
| 1,554,866 | A * | 9/1925 | Martin | F24C 5/18 | 236/6 |
| 1,879,954 | A * | 9/1932 | Smith | F23D 11/44 | 126/43 |
| 1,957,971 | A * | 5/1934 | Martin | F23L 17/10 | 454/37 |
| 2,065,265 | A * | 12/1936 | Bock | F23D 5/045 | 431/123 |
| 2,254,248 | A * | 9/1941 | Stirlen | F24C 9/00 | 126/43 |
| 2,383,488 | A | 8/1945 | Joy | | |
| 2,614,618 | A * | 10/1952 | Chadwick | F23D 5/045 | 431/218 |
| 2,637,377 | A * | 5/1953 | Budlane | F24C 5/20 | 431/208 |
| 2,721,608 | A | 10/1955 | Chinn | | |
| 2,893,713 | A * | 7/1959 | Haltmeier | B01D 3/20 | 261/114.2 |
| 3,165,102 | A | 1/1965 | Palmer | | |
| 3,267,833 | A * | 8/1966 | Artis | F23L 17/10 | 384/282 |
| 3,392,659 | A * | 7/1968 | Rousey | F23L 17/00 | 454/18 |
| 3,430,550 | A * | 3/1969 | Smith | F23L 17/00 | 416/197 A |
| 3,650,661 | A | 3/1972 | Laguinia | | |
| 3,703,166 | A | 11/1972 | White, Jr. | | |
| 3,782,303 | A * | 1/1974 | Pfister | F23L 17/00 | 110/162 |
| 4,050,442 | A * | 9/1977 | Seiverling | F21S 13/00 | 126/213 |
| 4,279,589 | A | 7/1981 | Ohmukai | | |
| 4,518,347 | A | 5/1985 | Sonetaka | | |
| 4,569,656 | A | 2/1986 | Shimizu | | |
| 4,641,571 | A * | 2/1987 | Anderson | F24F 7/025 | 454/19 |
| 4,793,321 | A | 12/1988 | Rafford | | |
| 4,972,823 | A * | 11/1990 | Stadin | F23D 14/20 | 126/39 J |
| 5,006,498 | A | 4/1991 | Kim | | |
| 5,819,640 | A * | 10/1998 | Cuomo | A47J 27/10 | 126/261 |
| 5,881,709 | A | 3/1999 | Daoust | | |
| 6,182,654 | B1 * | 2/2001 | Jones | F23J 11/08 | 110/162 |
| 6,347,936 | B1 | 2/2002 | Young | | |
| 6,431,973 | B1 * | 8/2002 | Tsung | F23L 17/10 | 454/18 |
| 2006/0172245 | A1 | 8/2006 | Hu | | |
| 2008/0155985 | A1 | 7/2008 | Labrador | | |
| 2009/0025703 | A1 | 1/2009 | Van Der Sluis | | |
| 2010/0083946 | A1 | 4/2010 | Cedar | | |
| 2010/0154778 | A1 | 6/2010 | Sun | | |
| 2010/0243228 | A1 | 9/2010 | Price | | |
| 2011/0017200 | A1 * | 1/2011 | Zwern | A47J 33/00 | 126/609 |
| 2011/0017679 | A1 * | 1/2011 | Zwern | C02F 1/04 | 210/767 |
| 2011/0021133 | A1 * | 1/2011 | Zwern | C02F 1/04 | 454/338 |
| 2011/0021134 | A1 * | 1/2011 | Zwern | C02F 1/04 | 454/343 |
| 2012/0060819 | A1 | 3/2012 | Hunt | | |
| 2012/0298053 | A1 | 11/2012 | Degrazia, Jr. | | |

FOREIGN PATENT DOCUMENTS

| | | | | | |
|---|---|---|---|---|---|
| DE | 102009043341 | | * | 9/2010 | F23D 3/26 |
| EP | 2101110 | A1 | | 9/2009 | |
| FR | EP 0950857 | A1 | * | 10/1999 | F23L 17/10 |
| FR | 2912205 | A3 | * | 8/2008 | F23D 11/106 |
| GB | 407553 | A | * | 3/1934 | F23C 7/004 |
| GB | 458994 | A | * | 12/1936 | F24C 5/20 |
| GB | 1147319 | A | * | 4/1969 | F23D 11/44 |
| GB | 2446163 | A | | 8/2008 | |
| JP | 56133513 | A | | 10/1981 | |
| JP | 58106314 | A | | 6/1983 | |
| JP | 10141668 | A | | 5/1998 | |
| MW | WO 2005054748 | A1 | * | 6/2005 | F23D 5/04 |
| RU | 2237217 | C2 | | 9/2004 | |
| WO | WO 8804533 | A1 | * | 6/1988 | A47J 36/26 |
| WO | WO 2007131378 | A1 | * | 11/2007 | F23L 17/10 |

* cited by examiner

COOKING STOVE

BACKGROUND OF THE INVENTION

1. Field of Invention

The invention relates to a portable stove that operates using a liquid fuel of alcohol and water that can be diluted to concentrations as low as 50% alcohol by volume.

2. Background of Invention

The present invention represents a novel liquid fuel stove. Conventional stoves do not operate properly or at all when the fuel mixture used in those stoves exceeds 20% water by volume. This is because when the fuel used by conventional liquid stoves contains 20% or greater water by volume the stove fails to generate enough heat to boil water or cook food. Presently there are no devices available that allow for the effective use of stove fuel containing greater than 20% water by volume.

However, the present invention allows the fuel to contain up to approximately 50% water by volume while still functioning as a stove, generating enough heat to boil water or cook food. The present invention is designed to generate efficient heat with a fuel mixture of approximately 40% water and 60% ethanol by volume, but is fully functional with alcohol fuels containing up to approximately 50% water by volume. Methanol may also be used as an addition to or as a substitute for the ethanol.

SUMMARY OF THE INVENTION

In accordance with one aspect of the invention, a cooking stove that operates with a liquid fuel containing alcohol and up to 50% water by volume is provided. The device may consist of a portable structure, a freestanding structure, or a structure that can be integrated into a domestic or commercial kitchen countertop. The device may contain a grill, one or more burners, a body, a fuel tank, a fuel filter, a fuel line, a fuel restrictor and a fuel valve.

DETAILED DESCRIPTION OF THE INVENTION

The device [10] is shown generally in FIGS. 1-6. The device [10] has a frame [12], a fuel tank [14] and an engine assembly [16]. As described below, the fuel tank [14] fits within the frame [12], and the engine assembly [16] is located within the frame [12]. In addition, a grill [18] may be placed on a top surface [20] of the frame [12] in a position above the engine assembly [16].

Figure 2:
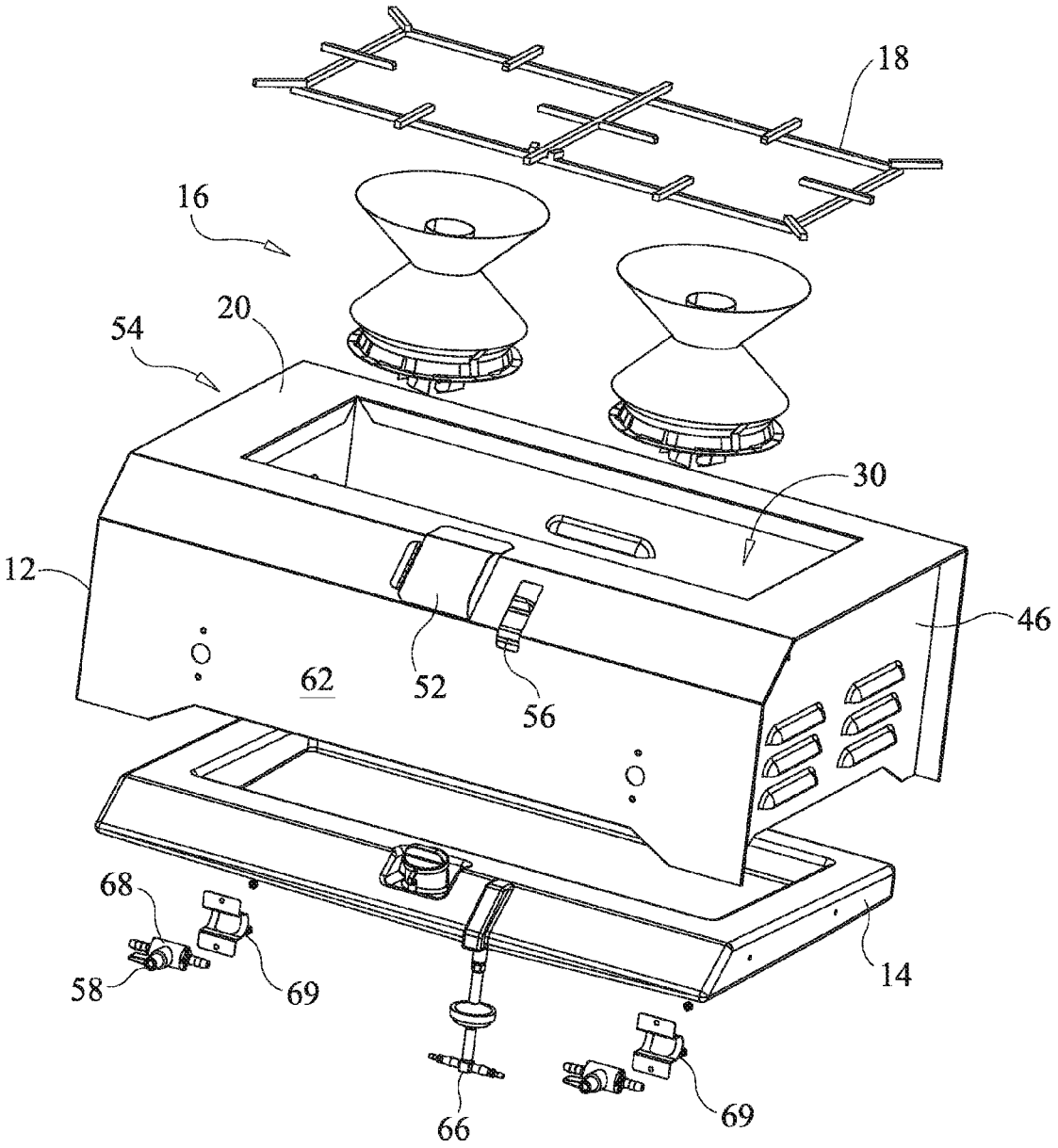
FIG. 2 is a perspective exploded view of the device.
Figure 3:
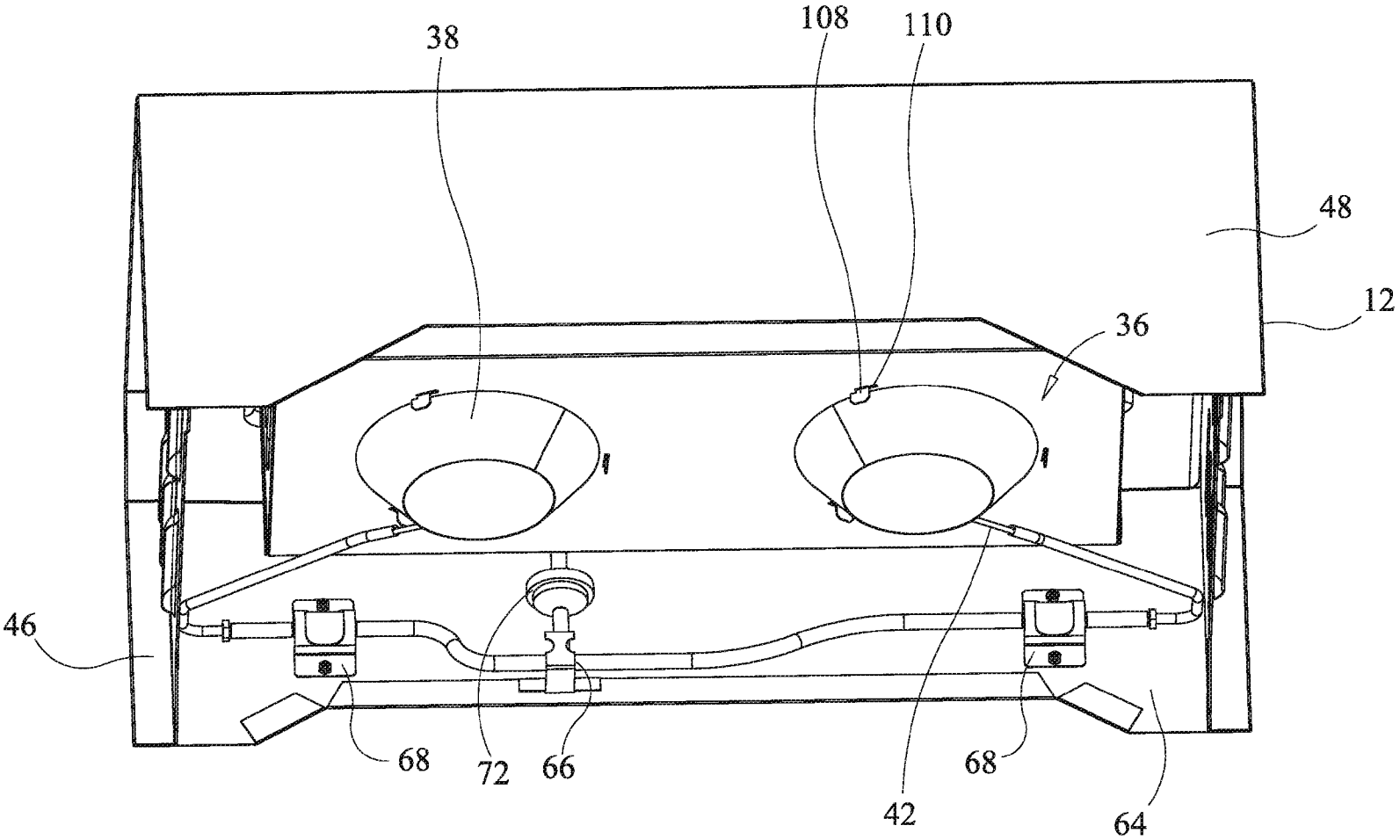
FIG. 3 is a bottom perspective view of the device.
Figure 4:
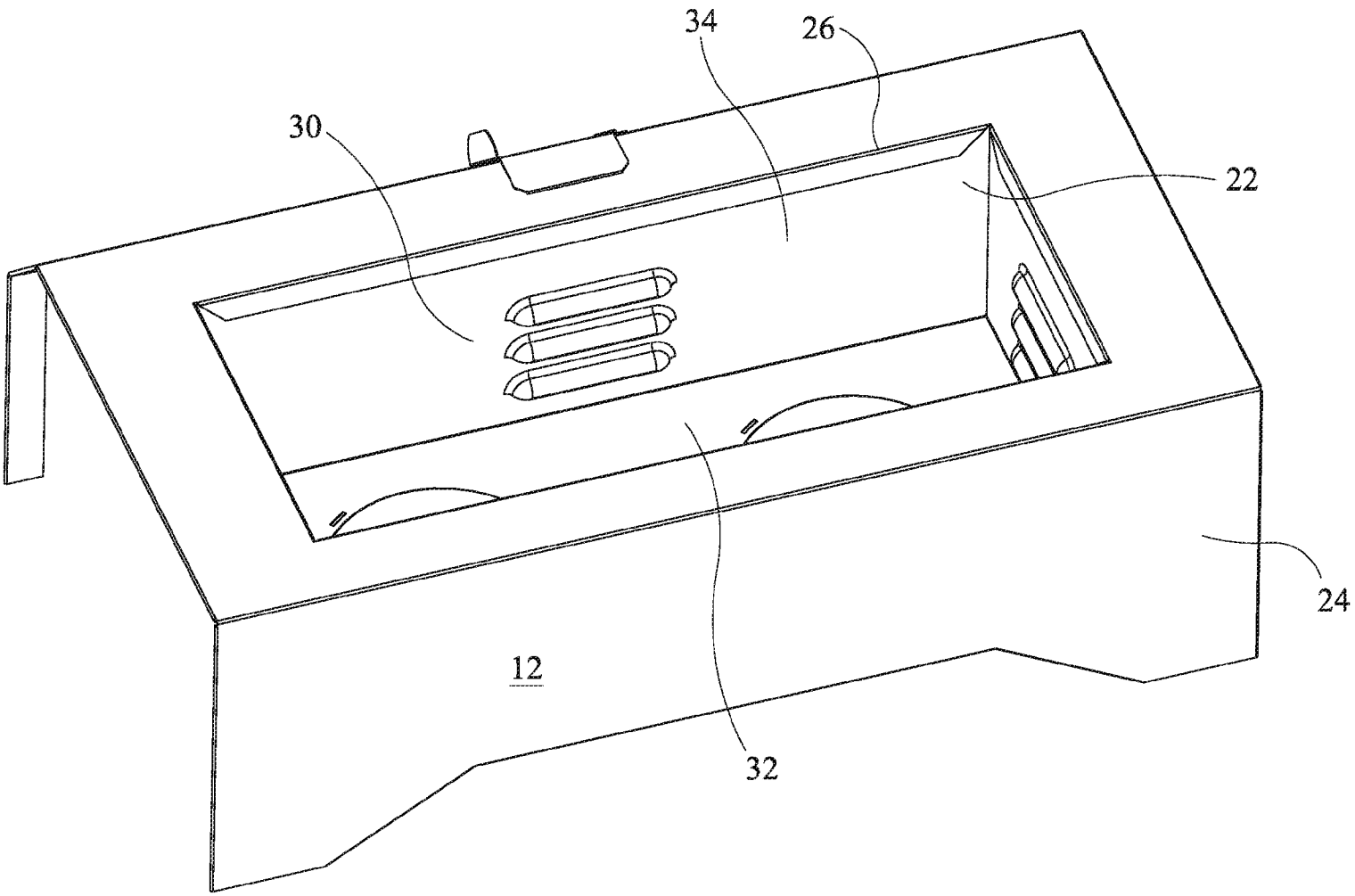
FIG. 4 is a top perspective view of the frame of the device.
Figure 5:
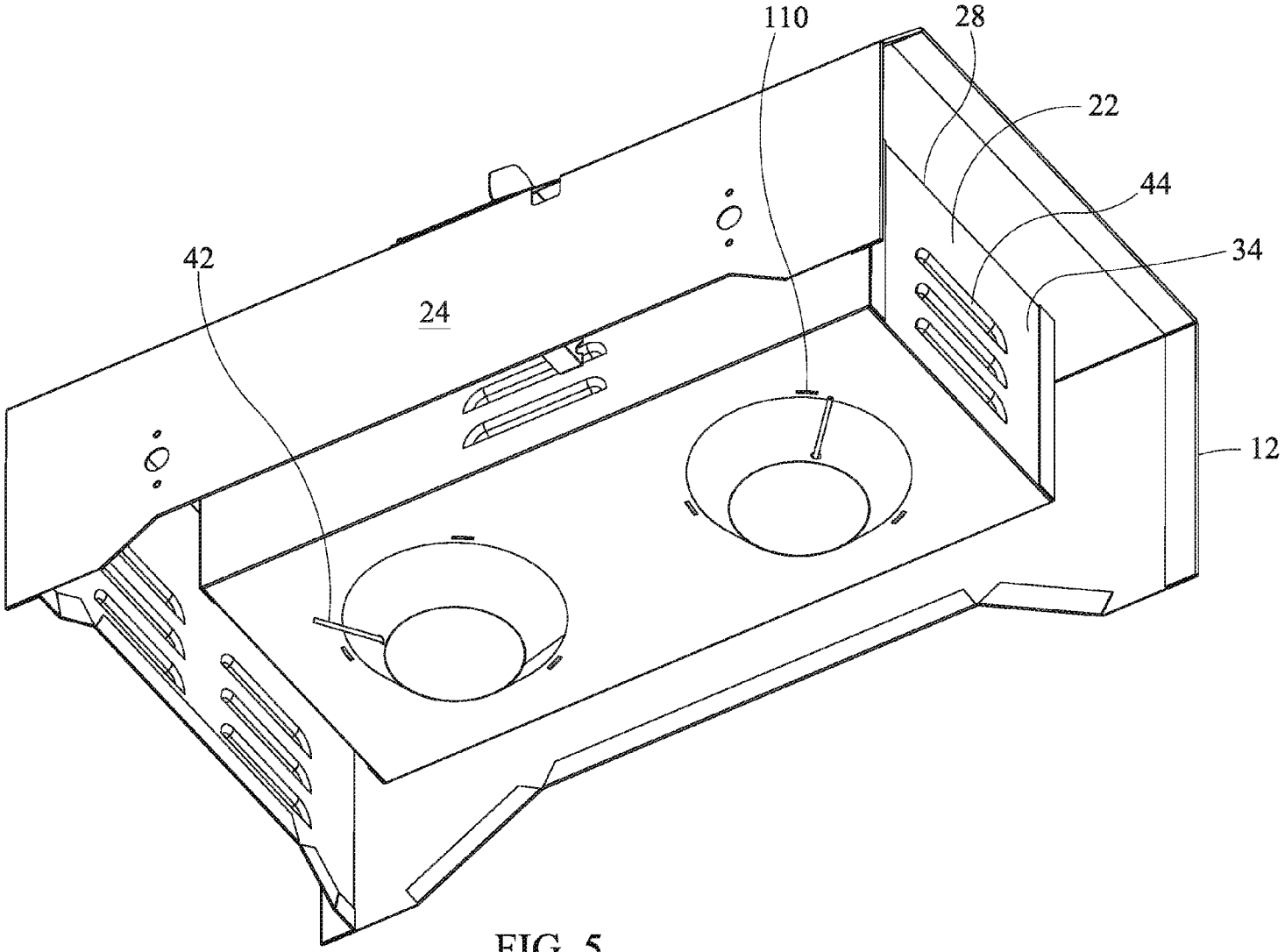
FIG. 5 is a bottom perspective cutaway view of the frame of the device.
Figure 6:
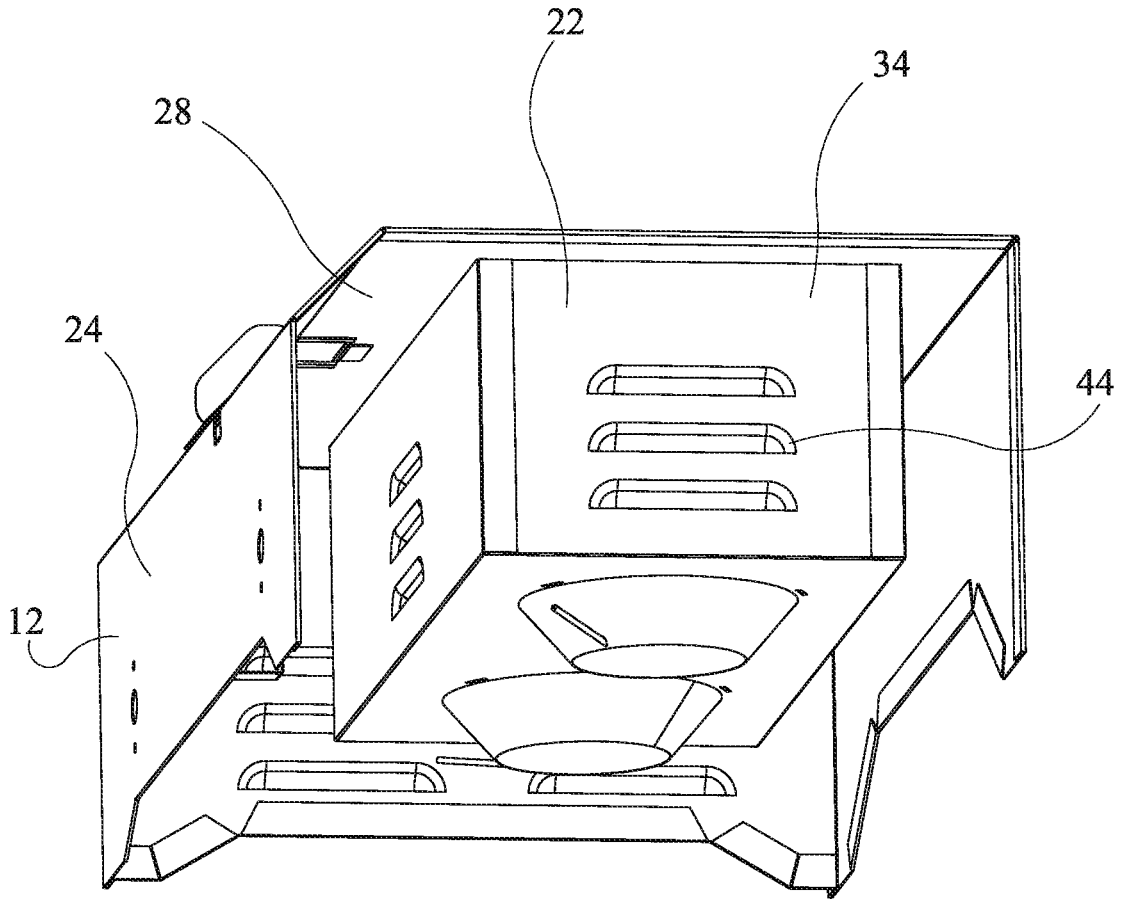
FIG. 6 is a side perspective cutaway view of the frame of the device.
Figure 7:
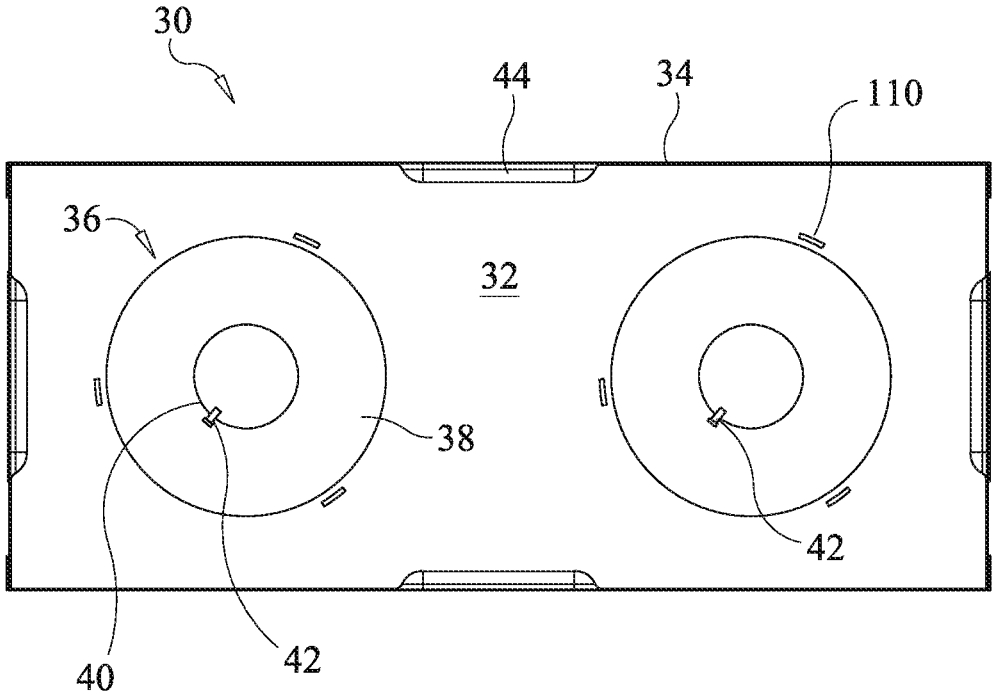
FIG. 7 is a top view of the inner portion of the frame.

The frame [ 12] is illustrated in FIGS. 1-7. As shown in FIGS. 4 and 5, the frame [12] includes an inner portion [22] and an outer portion [24]. The outer portion [24] includes a void [26]. The inner portion [22] includes a top edge [28] which is secured to the outer portion [24] at a perimeter of the void [26], thereby forming a recess [30] within the frame [12]. The void [26] and the top edge [28] are shown to be rectangular; however, other shapes, such as round, square and oval, are also contemplated. Other means for forming the recess [30] are also contemplated. The recess [30] has a recess bottom [32] and recess walls [34]. As shown in FIGS. 6 and 7, the recess bottom [32] includes one or more depressions [36] on the recess bottom [32]. The depressions [36] may have depression walls [38] which slope to a depression bottom [40]. One or more fuel distribution nozzles [42] may be attached to the frame [12] through the depression walls [38] to distribute fuel into the depression [36]. One or more fuel distribution nozzles [42] may be used for each depression [36].

The recess walls [34] may also include one or more vents [44]. The vents [44] may be on one or more recess walls [34], and one or more vents [44] may be on each recess wall [34] having a vent [44]. The vents [44] may be formed from the recess walls or they may be placed in holes made in the recess walls [34].

As shown in FIGS. 3 and 4, the outer portion [24] of the frame [12] also has frame outer portion side walls [46] and a frame outer portion back wall [48]. Outer frame vents [50] may be located on one or more of the frame outer portion side walls [46] or the frame outer portion back wall [48] or both.

Figure 1:
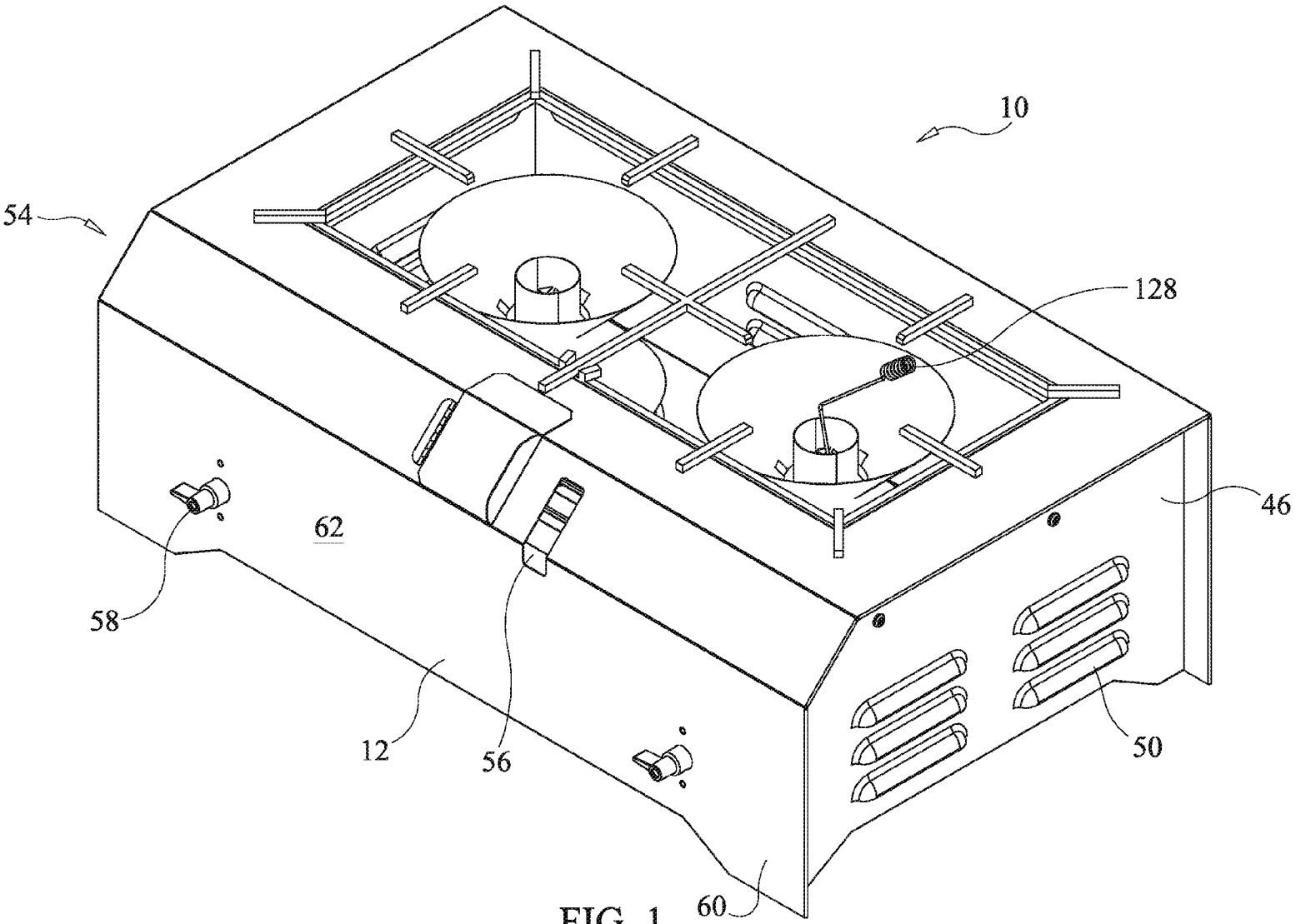
FIG. 1 is a perspective view of the device.

The outer portion [24] of the frame [12] may also include a fuel tank access door [52] located at a top end [54] of the outer portion of the frame [12]. As shown in FIGS. 1 and 2, a cutout [56] may be made near the top end [54] of the outer portion [24] of the frame [12] so that the amount of fuel in the fuel tank [14] may be observed. A transparent or translucent pane, with or without markings to show the level of fuel in the fuel tank [14], may be inserted in the cutout [56]. In addition, one or more fuel flow controls [58] may be placed upon the frame [12], and may be located on a front surface [60] of a control panel [62] on the outer portion [24] of the frame [12]. On the back surface [64] of the control panel [62] may be located a fuel distributor [66] and one or more fuel valves [68], The fuel valves [68] are accessible by the user and are in mechanical connection with the fuel flow controls [58] or restrictors and are controlled by the fuel flow controls [58]. The fuel distributor [66] and the fuel valves [68] may be attached to the back surface [64] of the control panel [62] by one or more clamps [69] or by other equivalent means known in the art.

Figure 8:
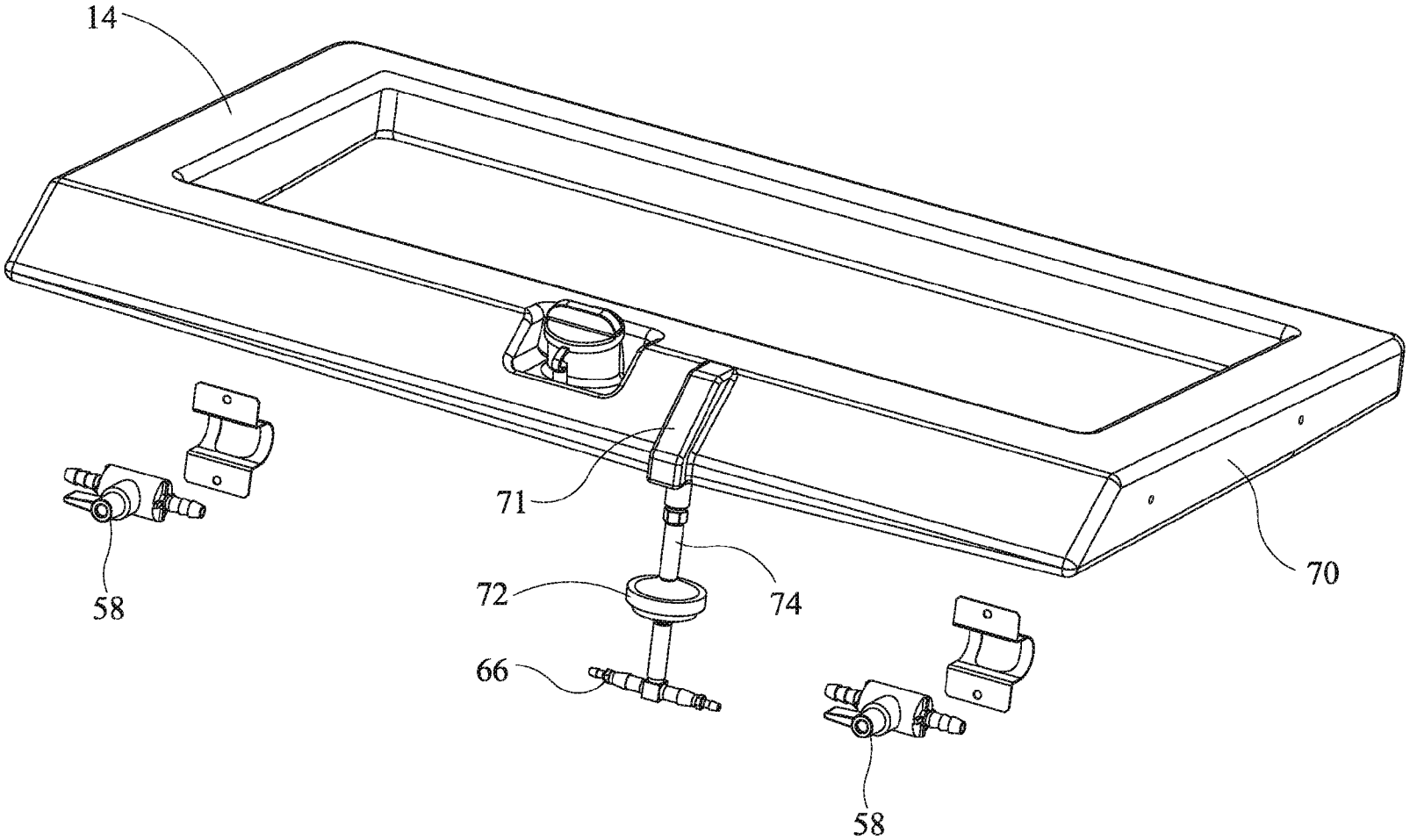
FIG. 8 is a perspective view of the fuel tank of the invention and portions of the fuel distribution system.
Figure 9:
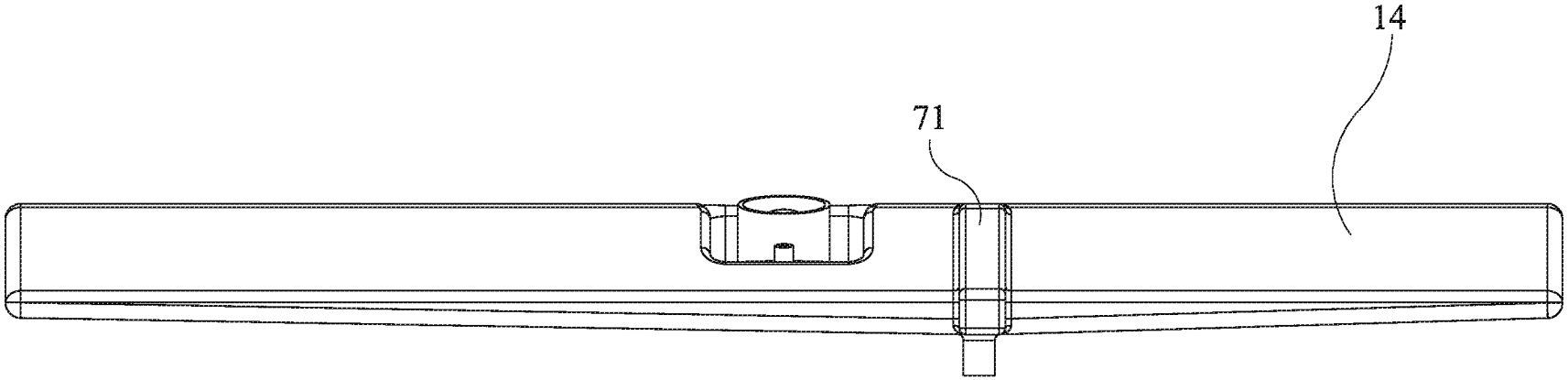
FIG. 9 is a front view of the fuel tank of the invention.

The fuel tank [14] is illustrated in detail in FIGS. 8 and 9. As shown in FIG. 2, the fuel tank [14] is shaped to fit within the frame [12] between the inner portion [22] and the outer portion [24] of the frame [12]. The fuel tank [14] may be annular as illustrated, or it may be of some other shape, such as C-shaped or have an elongated shape. The fuel tank [14]

may be attached to the frame by friction or by securing clips or some other means known in the art. The fuel tank [14] may include projections [70] to help it stay secured to the interior of the frame [12]. The fuel tank [14] may also comprise a second projection [71] corresponding to a cutout in the outer frame so that the interior of the fuel tank [14] may be viewed while maintaining the profile of the frame [12].

A fuel filter [72] may be attached to the fuel tank [14] as shown in FIGS. 3 and 8, and may be attached to the fuel tank [14] by a fuel filter tube [74]. Alternatively, the fuel filter [72] may be attached directly to the fuel tank [14] at a point on the fuel tank [14] where fuel is filtered before flowing from the fuel tank [14]. The direct attachment may be made by a screw fitting with complementary threads between the fuel filter and the tank. Also, other means for connecting the fuel filter and the fuel tank are contemplated. The fuel distributor [66] may be attached to the open end of the fuel filter [72] so that filtered fuel is distributed to the fuel distribution nozzles [42] within the depressions [36] in the frame [12]. One or more fuel tank lines may connect the fuel tank [14] to one or more fuel distributors [66] through the fuel filter [72]. One or more fuel distribution lines distribute fuel from the fuel distributor [66] to one or more fuel valves [68], and one or more fuel outlet lines distribute fuel from the fuel valves [68] to the fuel distribution nozzles [42]. The flow of fuel may be from gravity or by means of a fuel pump.

Figure 10:
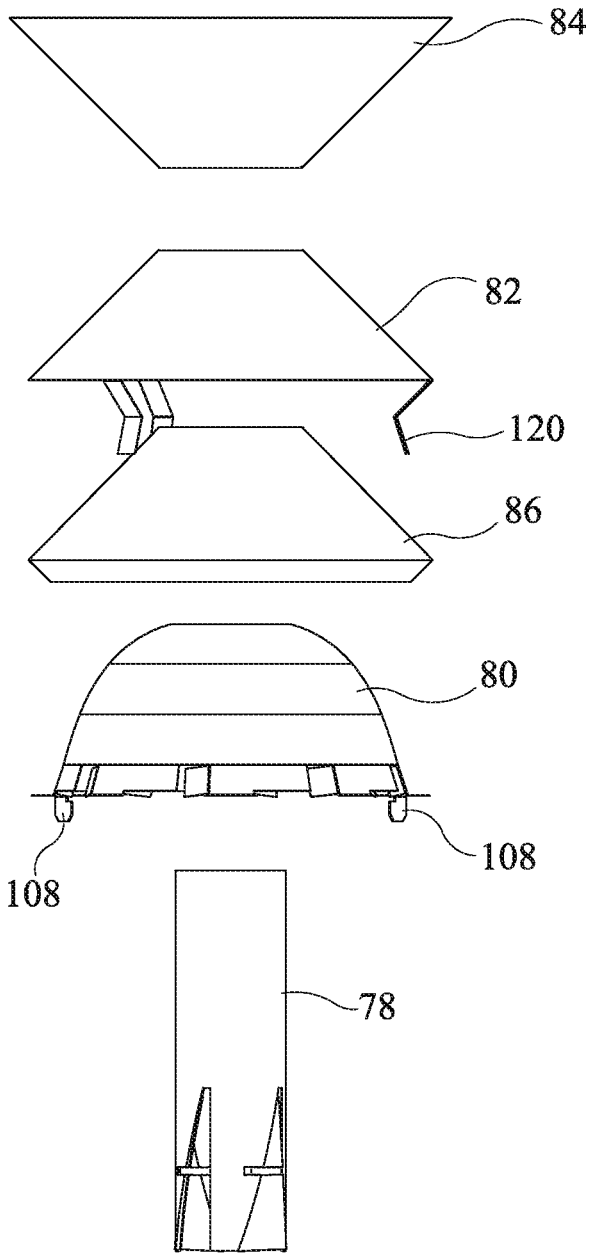
FIG. 10 is an exploded side view of the engine assembly of the invention.
Figure 11:
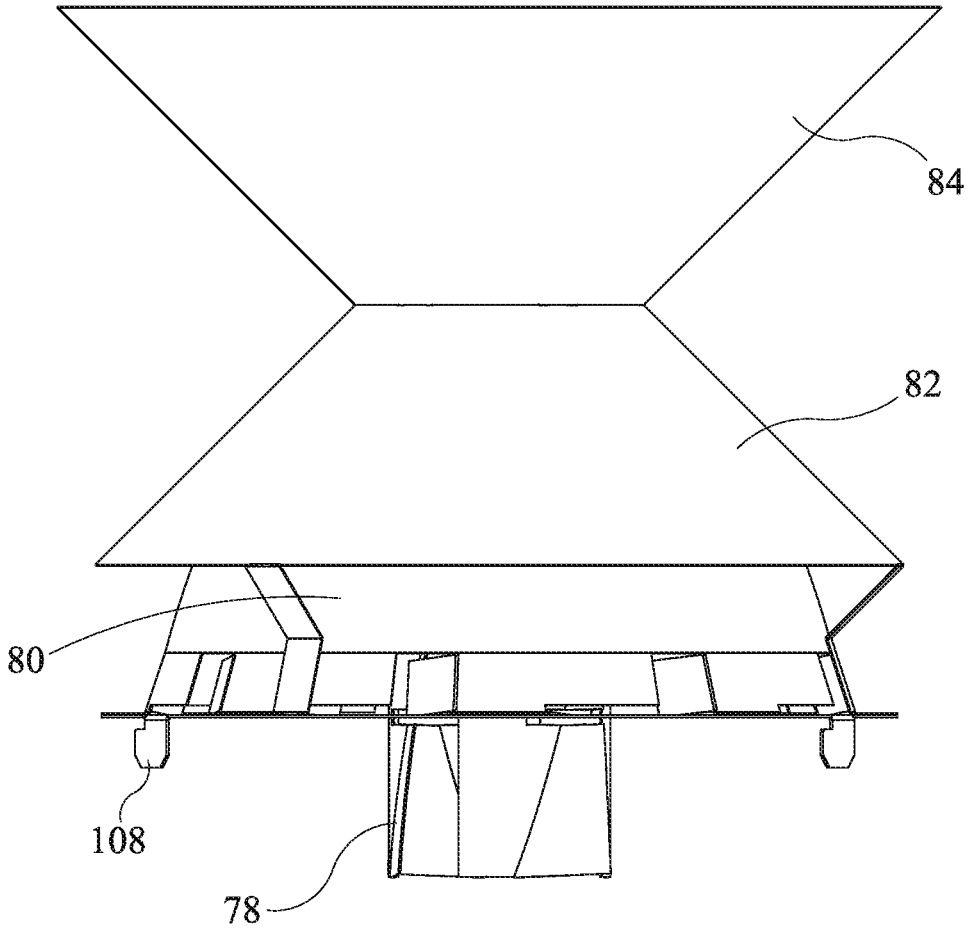
FIG. 11 is a side view of the engine assembly of the invention.

As shown in FIG. 2, located within the recess [30] is an engine assembly [16] for combustion of the fuel. The engine assembly is located within the depression [36] on the recess bottom [32]. As shown in FIGS. 10 and 11, the engine assembly [16] comprises a central chimney [78], a turbine [80], an insulator [82] and deflector [84]. There may also be an insulation blanket layer [86] between the turbine [80] and the insulator [82].

Figure 12:
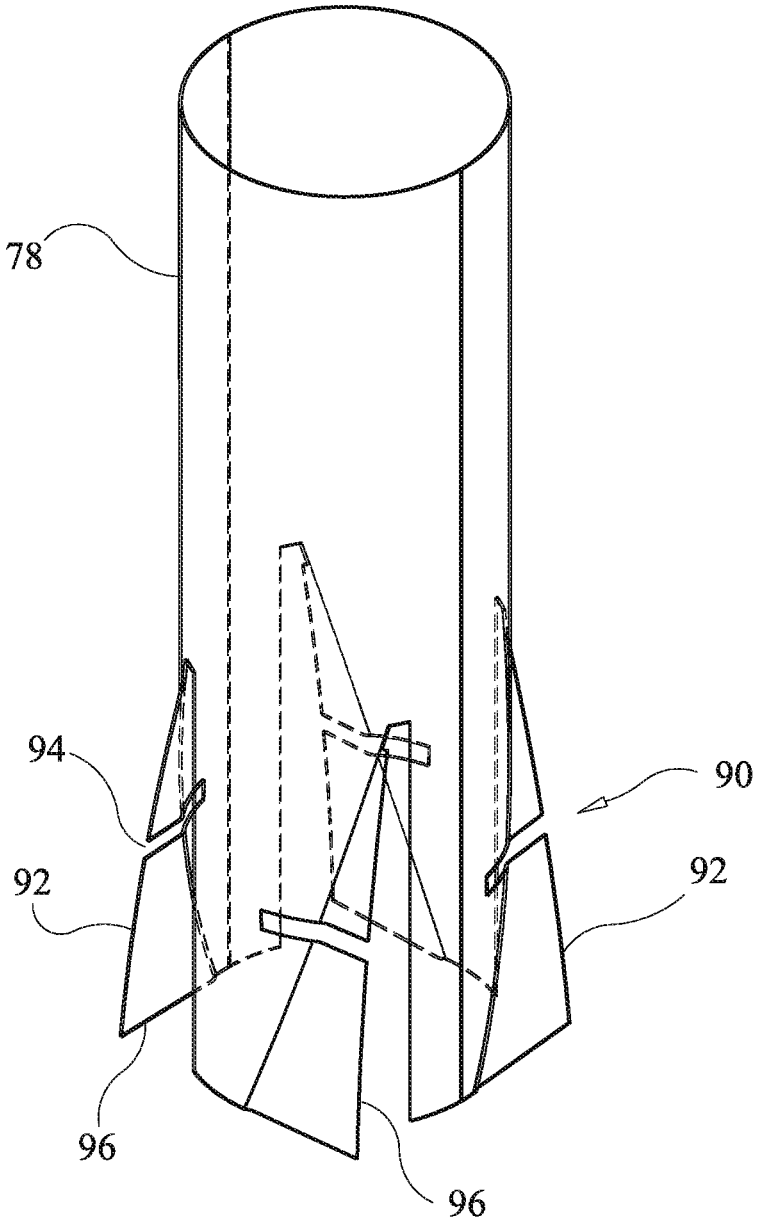
FIG. 12 is a perspective cutaway view of the chimney of the invention.
Figure 13:
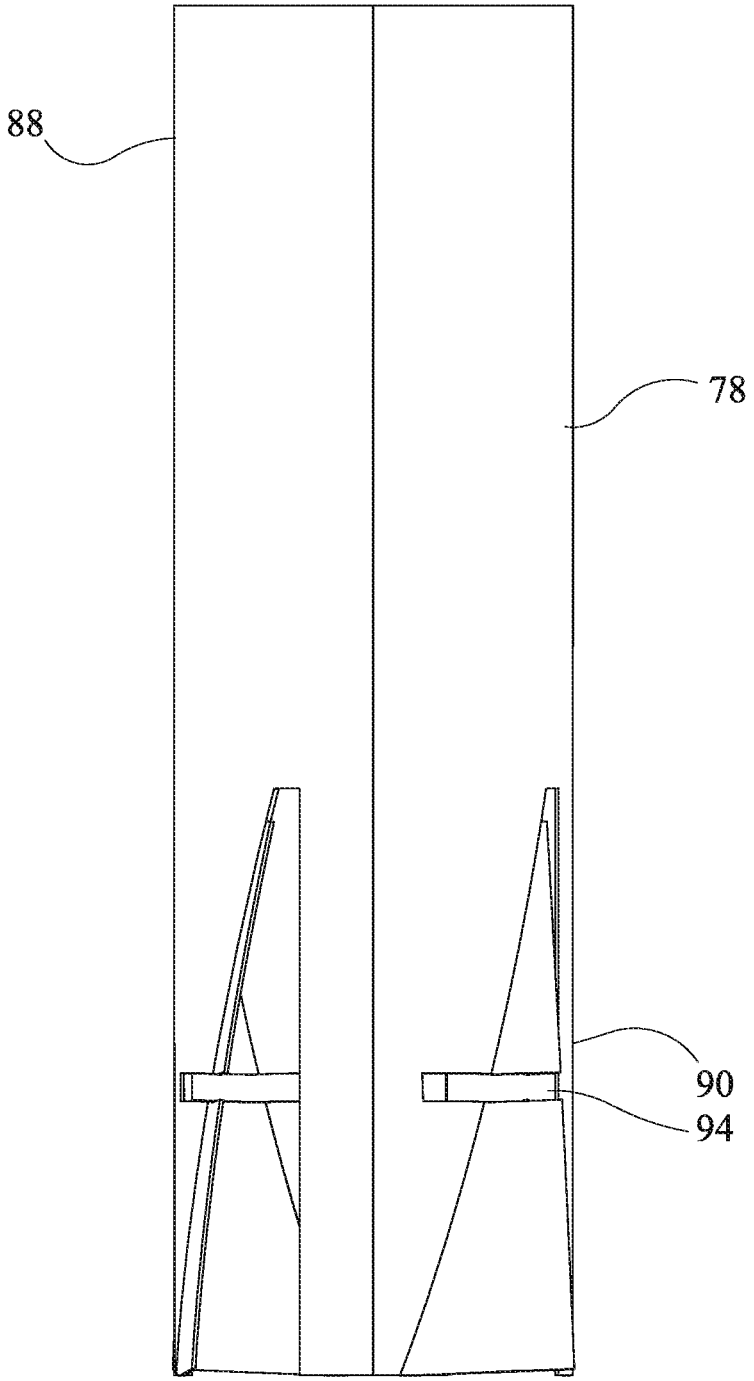
FIG. 13 is a side view of the chimney of the invention.

The chimney [78] is shown in FIGS. 12 and 13. The chimney [78] has a generally cylindrical shape having a top end [88] and a bottom end [90]. The bottom end [90] has at least one chimney fin [92] extending outward from a circumference of the chimney [78]. In addition, there may be one or more transverse cuts [94] located on the chimney fin [92] generally at a middle portion of the chimney fin [92]. The bottom end [90] of the chimney [78] also may include one or more vents [96] to allow air to flow into the chimney [78].

Figure 14:
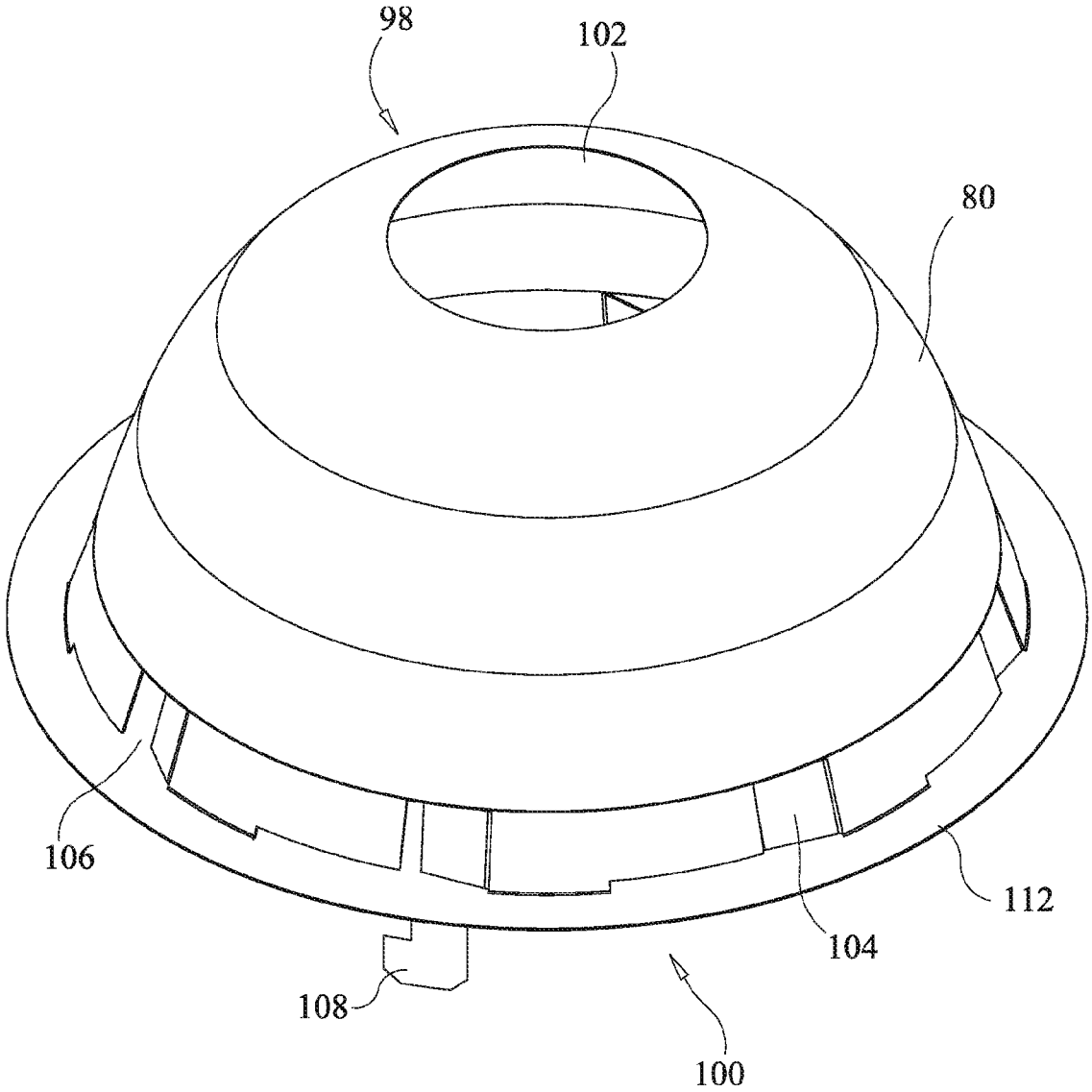
FIG. 14 is a perspective view of the turbine of the invention.

The turbine [80] is shown in FIG. 14. The turbine [80] has a top side [98] and a bottom side [100]. The top side [98] and the bottom side [100] of the turbine [80] are open. The turbine [80] has a top side hole [102] in the top side [98] in a size and shape complementary to the size and shape of the outside of the chimney [78] for receiving the chimney [78]. The turbine [80] may also have one or more turbine fins [104] and turbine slots [106] located at the bottom side [100] of the turbine [80]. A plurality of inward facing turbine fins [104] may be spaced around the bottom side [100] of the turbine [80], providing a passage for air from outside the turbine [80] to inside the turbine [80] through the turbine slots [106]. The bottom side [100] of the turbine [80] may also include a securing mechanism for attachment of the turbine [80] to the recess bottom [32]. One securing mechanism may be one or more J-lock tabs [108] and corresponding slits [110] in the recess bottom [32], as shown in FIGS. 3 and 7. Other means for securing the turbine [80] to the recess bottom [32] known in the art, such as a turbine depression in the recess bottom to allow a press fitting of the turbine onto the recess bottom [32], are also contemplated. In addition, the bottom side [100] of the turbine [80] may include a lip [112] to minimize air flow into the turbine [80] from anywhere other than the turbine slots [106]. The turbine [80] may be generally bowl shaped and may have the top side [98] with a smaller radius than the bottom side [100].

Figure 15:
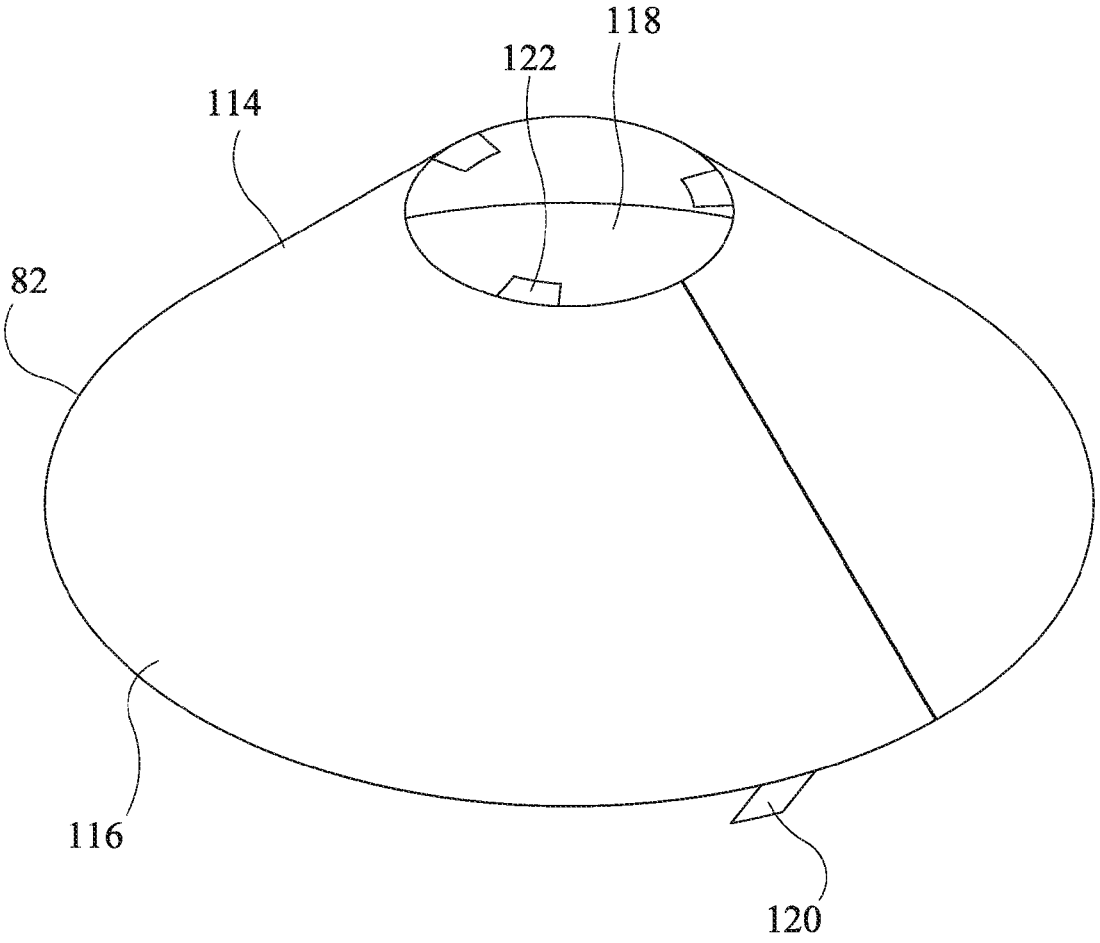
FIG. 15 is a perspective view of the insulator of the invention.

An insulator [82] is shown in FIG. 15. The insulator [82] may be generally conical in shape, and of a size so that it may fit over the turbine [80] during operation. The insulator [82] has an insulator top end [114] and an insulator bottom end [116]. Both ends are open. The insulator top end [114] has an opening [118] sized to allow the chimney [78] to pass through and extend above the insulator top end [114] during operation.

As shown in FIG. 15, the insulator [82] may include insulator bottom end tabs [120] so that the insulator bottom end [116] may be mechanically connected to the bottom side [100] of the turbine [80] through having the bottom end tabs [120] placed in the turbine slots [106]. Other means for connecting the turbine [80] directly or indirectly with the insulator [82] are also contemplated. In addition, the insulator [82] may include insulator top end tabs [122] so that the top end [114] of the insulator [82] may attach to the bottom end of the deflector [84] as described below. Other means for connecting the deflector with the insulator are also contemplated.

Figure 16:
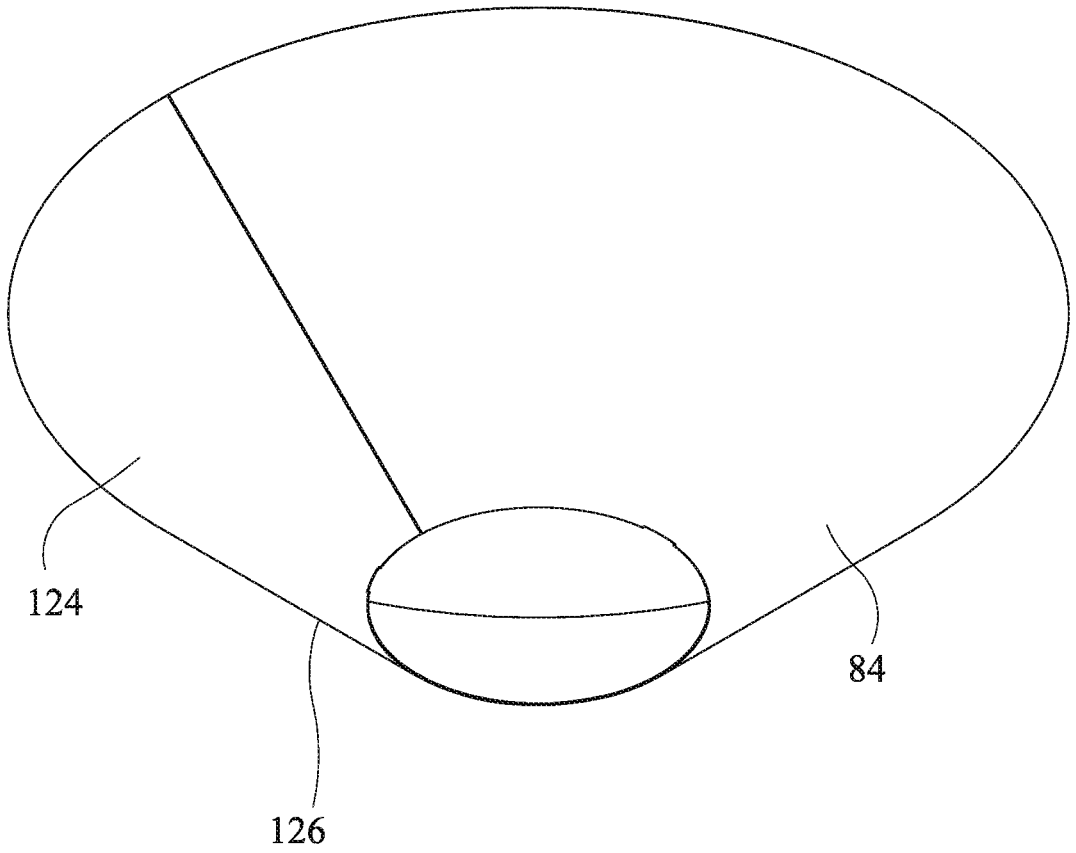
FIG. 16 is a perspective view of the deflector of the invention.

A deflector [84] is shown in FIG. 16. The deflector [84] is open at both ends and is generally conical in shape. The deflector [84] may be placed in inverted orientation with respect to the insulator [82], as shown in FIG. 10. The deflector [84] has a top portion [124] and a bottom portion [126]. The top portion of the chimney [88] that extends above the top portion of the turbine [98] and the top portion of the insulator [114] passes through an opening in the bottom portion of the deflector [126]. The bottom portion of the deflector [126] may be attached to the top portion of the insulator [114] by having the top end tabs [122] of the insulator [82] extend into the opening in the bottom portion of the deflector so that the deflector and the insulator are held together by friction. Other means for connection are also considered. Alternatively, the insulator and the deflector may be formed into a single piece.

In addition, as shown in FIG. 10 the insulation blanket layer [86] between the turbine [80] and the insulator [82] may also be conical in shape so it may fit between the turbine [80] and the insulator [82]. The insulation blanket layer [86] may be made from ceramic wool or an equivalent material to provide improved insulation.

In operation, the turbine, insulation, insulator, deflector, and chimney may be assembled prior to placement within the frame. These components may all also be secured in their respective orientations each with the other. Also, the stove may be made operational through the use of an extended lighter [128], as shown in FIG. 1.

The combustion engine assembly may be attached to the recess bottom through hooks, welding, or other means.

Alternatively, a fuel tank may be located outside the frame but otherwise connected to the fuel distribution system of the invention so that the stove may be operated.

Also, in operation, initial fuel may be placed in the bowl by opening the fuel control and allowing a predetermined amount of fuel to flow from the fuel tank to the depression. Alternatively, flowing fuel may be brought to the depression, and the user may ignite the fuel as it flows into the depression.

In another embodiment of the device, the device can be built into a countertop.

In yet another embodiment of the device, legs can be attached to the lower part of the body of the device to elevate the device for ease of use by the end user.

There has been described a new and useful stove. It is apparent that those skilled in the art may make numerous modifications and departures from the specific embodiments described herein without departing from the spirit and scope of the claimed invention.

The invention claimed is:

1. A domestic cooking stove comprising:

a frame, having a frame outer portion having a top section with a void, a frame inner portion having a top section attached to a perimeter of the void, forming a frame recess having a recess bottom, and at least one depression in the recess bottom; and a combustion engine located in the depression, including a central chimney having a bottom end located in the depression, a turbine having a top side having a top side hole complementary to the chimney positioned around the chimney, a generally conical turbine insulator positioned above the turbine and around the chimney; and an inverted conical deflector positioned above the insulator and over a top end of the chimney.

2. The stove of claim 1, further comprising an insulation blanket layer between the turbine and the insulator.

3. The stove of claim 1, wherein the frame inner portion comprises inner portion side walls having inner portion side wall vents, and the frame outer portion comprises outer portion side walls having outer portion side wall vents.

4. The stove of claim 1, further comprising a fuel tank located within the frame between the frame outer portion and the frame inner portion.

5. The stove of claim 4, wherein the fuel tank is annular.

6. The stove of claim 1, wherein the central chimney further comprises one or more chimney vents located at the bottom end of the chimney; and one or more chimney fins located at the bottom end of the chimney.

7. The stove of claim 6, wherein the chimney further comprises one or more transverse cuts made into the chimney fin located generally towards the middle of the chimney fin.

8. The stove of claim 6, wherein the turbine further comprises a bottom side having one or more inward facing turbine fins, one or more turbine slits, and a securing mechanism for attachment of the turbine to the recess bottom.

9. The stove of claim 8, wherein the recess bottom further comprises slits, and the securing mechanism for attachment of the turbine to the recess bottom comprises one or more J-lock tabs corresponding to the slits, and a turbine bottom side further comprises a lip.

10. The stove of claim 9, wherein the turbine further comprises a bowl shape.

11. The stove of claim 8, wherein the insulator comprises an insulator bottom end having tabs complementary to the turbine slits.

12. The stove of claim 1, wherein the deflector and the insulator are formed as a single piece.

13. The stove of claim 1, further comprising a fuel tank including a fuel mixture of water and alcohol, the fuel tank being in fluid communication with the at least one depression so as to provide the fuel mixture to the at least one depression.

14. The stove of claim 1, wherein the chimney includes a cylindrical body that extends through the turbine, turbine insulator, and deflector.

15. The stove of claim 1 wherein the turbine circumscribes the chimney.

16. The stove of claim 1, wherein:

the chimney has a cylindrical chimney body defining an chimney interior that extends along a cylindrical axis from the bottom end to the top end, the bottom end includes a plurality of circumferentially spaced vents formed through the cylindrical chimney body for allowing air to flow into the chimney interior;

the turbine includes a hollow turbine body circumscribing the cylindrical chimney body and defining a turbine interior;

the turbine body extends coaxially with the cylindrical chimney body from an open turbine bottom side to the top side hole in such a way that the cylindrical chimney body passes through the open turbine bottom side and top side hole; and the turbine body includes a plurality of circumferentially spaced slits formed through the turbine body for allowing air to flow into the turbine body.

* * * * *